US010925445B1

(12) United States Patent
Garcia

(10) Patent No.: US 10,925,445 B1
(45) Date of Patent: Feb. 23, 2021

(54) TOILET SEAT SUPPORT DEVICE FOR A PORTABLE TOILET SYSTEM

(71) Applicant: Richard Garcia, San Jose, CA (US)

(72) Inventor: Richard Garcia, San Jose, CA (US)

( * ) Notice: Subject to any disclaimer, the term of this patent is extended or adjusted under 35 U.S.C. 154(b) by 0 days.

(21) Appl. No.: 16/796,212

(22) Filed: Feb. 20, 2020

(51) Int. Cl.
*A47K 13/26* (2006.01)
*A47K 11/12* (2006.01)
*A47K 11/04* (2006.01)

(52) U.S. Cl.
CPC ..... *A47K 13/26* (2013.01); *A47K 11/04* (2013.01); *A47K 11/12* (2013.01)

(58) Field of Classification Search
CPC ..... A47K 11/06; A47K 13/005; A47K 11/04; A47K 11/10
USPC ..... 4/483, 484
See application file for complete search history.

(56) References Cited

U.S. PATENT DOCUMENTS

2014/0157505 A1* 6/2014 Cheung ..... A47K 11/02 4/483
2017/0215660 A1* 8/2017 Noy ..... A47K 11/06

* cited by examiner

*Primary Examiner* — Lauren A Crane
(74) *Attorney, Agent, or Firm* — Stephen E. Zweig

(57) ABSTRACT

A toilet seat support device that can be used as the basic chassis to construct a portable toilet, such as a composting toilet for camping use. The device is configured with suitable fixtures for other components, such as a standard toilet seat, a waste collection bucket, detachable legs, and other devices to be rapidly mounted onto the chassis, or disassembled for transport or storage.

17 Claims, 9 Drawing Sheets

TOILET SEAT SUPPORT DEVICE FOR A PORTABLE TOILET SYSTEM

BACKGROUND OF THE INVENTION

Field of the Invention

This invention is in the field of portable toilets, camping toilets, composting toilets, and waste management.

Description of the Related Art

Toilets, defined as devices to collect human solid and liquid excrement, are ancient devices that have been in use for thousands of years. These include simple chamber pots, bucket toilets, outhouses, latrines, commodes, and the like, as well as the more complex water-based flush toilets in popular use.

Modern flush toilets typically operate with various types of standard toilet seats, which can be screwed onto the flush toilet on a semi-permanent basis. These standard toilet seats are well designed for comfort, and as a result, users tend to expect that a good toilet will be compatible with such toilet seats.

In addition to the flush toilets, there is also commercial demand for various types of camping toilets and composting toilets, and many types of camping toilets and composting toilets are presently on the market. Camping toilets can be very inexpensive. By contrast, composting toilets are often considerably more expensive and elaborate. To help implement the composting functionality, it may be useful to separate out the urine components from the solid components, thus providing a urine diversion toilet.

BRIEF SUMMARY OF THE INVENTION

The present invention was inspired, in part, by the insight that inexpensive camping toilets and composting toilets generally tend to be incompatible with standard toilet seats. This can create a sub-optimal user experience. Improved designs that can accommodate standard toilet seats are thus desirable.

The present invention was also inspired, in part, by the insight that a fair number of inexpensive camping toilets and composting toilet designs, particularly those designed to be stored in a compact configuration, and then extended for use, also fail to adequately stabilize the user while using the toilet. Improved designs that can both disassemble and then assemble into a configuration that can adequately stabilize the user (e.g. an adult human, often with a weight between 100 to 300+ pounds) would also be desirable.

As will be discussed, the present disclosure teaches a toilet seat support device that can be used as the basic chassis to construct a portable toilet, such as a composting toilet for camping use. The device is configured with suitable fixtures for other components, such as a standard toilet seat, a waste collection bucket, detachable legs, and other devices to be rapidly mounted onto the chassis, or disassembled for transport or storage.

BRIEF DESCRIPTION OF THE DRAWINGS

In FIG. 2, the toilet seat lid of the standard toilet seat is "up", and is resting against the toilet lid support at an angle of about 90 degrees.

DETAILED DESCRIPTION OF THE INVENTION

Figure 1:
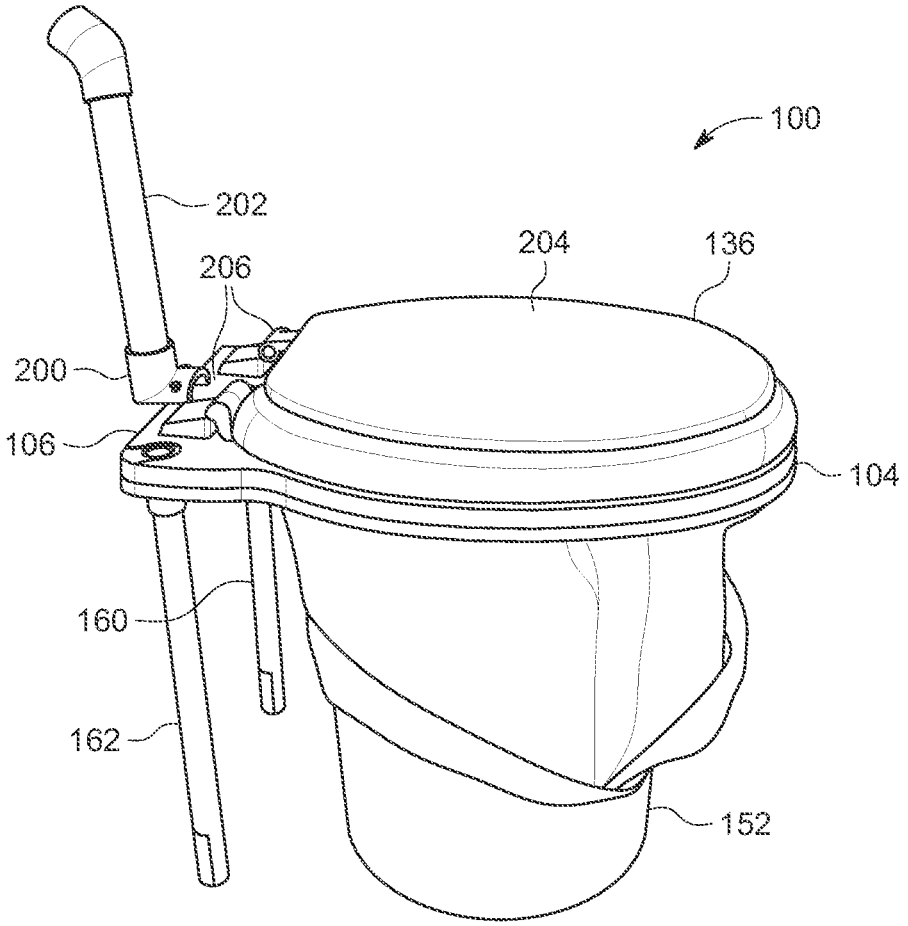
FIG. 1 shows a side overview of the toilet seat support device, which is the underlying chassis for the invention, here equipped with additional components, including a standard toilet seat, toilet lid support, right and left legs, and a waste receptacle. This thus produces a portable toilet. In this view, the toilet seat lid of the standard toilet seat is down.

FIG. 1 shows a left side overview of the toilet seat support device (shown in more detail in FIG. 5, 102), showing its front side (104) and back-side (106). This toilet seat support device serves as the underlying chassis for the invention. The toilet seat support device is equipped with many additional components, and thus produces a complete composting toilet (100). These additional components include a standard toilet seat (136), a toilet lid support (202), right and left legs (160, 162), and a waste receptacle (152). In this view, the toilet seat lid (204) of the standard toilet seat (136) is "down", and thus is at an angle of zero degrees. In the following discussion, note that the various indicia may be distributed between FIGS. 1-13.

In some embodiments, the invention may be a toilet seat support device (102) for a portable composting toilet (100). This toilet seat support device will typically comprise a substantially planar toilet seat support device (102) comprising a front side (104), a backside (106), a left side (108), a right side (110), a top layer (or top side 112), and a bottom layer (or bottom side 114).

In a preferred embodiment, this toilet seat support device (102) will have an axis of symmetry (116) passing between a middle of the front side (118) and a middle of the backside (120) so that the device's left side (108) is symmetric with respect to the device's right side (110).

The toilet seat support device will typically further comprise a first central oval opening (122) in the device's top layer (112). This is superimposed over a slightly larger second central oval opening (124) in the device's bottom layer (114). The second central opening will often have a diameter between ½ inch and 2 inches larger than the first central opening. This configuration thus produces a stepped central oval opening (126) passing completely through the device's top layer (112) and the device's bottom layer (114). The step, often about ¼ inch to 1 inch wide, can be seen in FIG. 5 as (125).

The bottom layer of the device's backside will typically be configured with both right (128) and left (130) leg attachment fixtures, each positioned on opposite sides of the device's axis of symmetry (116).

On the backside of the device (106), the device's top layer (112) and the device's bottom layer (114) are configured with right (132) and left (134) toilet seat fixture openings, each positioned on opposite sides of the axis of symmetry (116). These toilet seat fixture openings are positioned and configured so that when a standard toilet seat (136) may be mounted on the device's top layer (112) by way of nuts or bolts (208, 210) which protrude through these right (132) and left (134) toilet seat fixture openings. These are held in place by corresponding nuts or screw mounts (138, 140). The standard toilet seat opening (142) will be positioned above the device's stepped central opening (126) in the device's top layer (112).

The device's stepped central oval opening (126) is typically configured with at least an upper central opening (122) and a lower central opening (124) so that this lower central opening (124) can pass over the rim (150) of a substantially cylindrical waste receptacle (152) (such as a bucket), while the device's upper central opening (124) and step (125) is in contact with the rim (150) of this substantially cylindrical waste receptacle (152).

Figure 2:
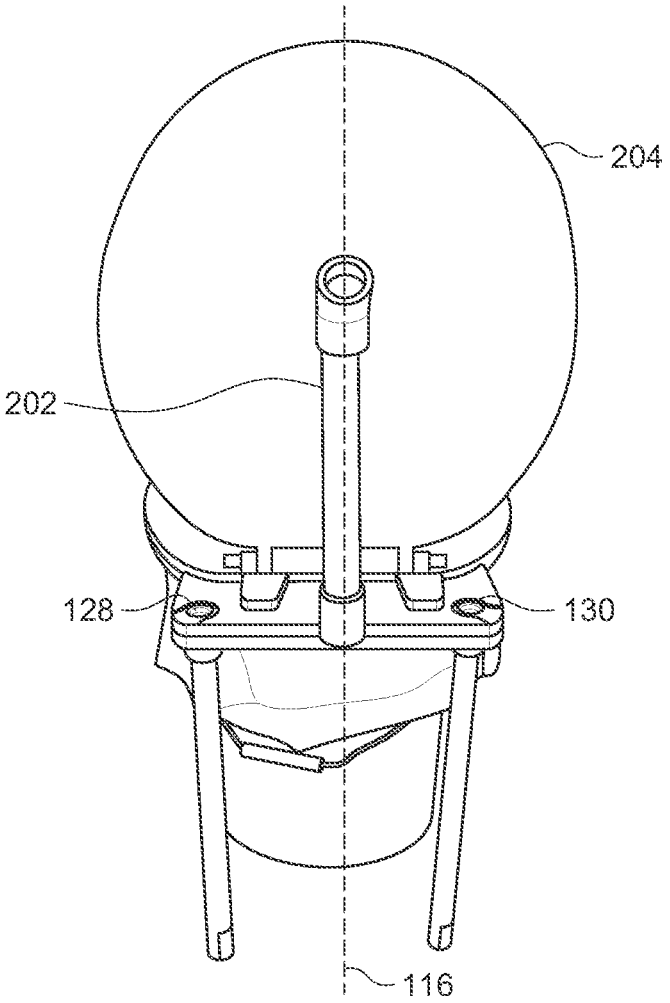
FIG. 2 is a rear view of the toilet seat support device and attachments previously shown in FIG. 1.

FIG. 2 shows a rear view of the toilet seat support device which is equipped with the attachments previously shown in FIG. 1. In FIG. 2, the toilet seat lid (204) of the standard toilet seat is "up" (here at an angle of about 90 degrees), and is resting against the toilet lid support (202).

In some embodiments, the device's backside (106) further comprises at least one toilet lid support attachment fixture (200). A toilet lid support (202) is attached to this toilet lid support attachment fixture (200). A standard toilet seat (136) (typically comprising a standard toilet seat lid (204) and hinge (206) structure and toilet seat opening 142) is mounted on the device top layer (112) (usually by way of any of bolts or screws (208, 210) protruding through the right (132) and left (134) toilet seat fixture openings).

The toilet lid (202) support functions to prevent the standard toilet seat lid (204) from swinging around its hinge structure (206) to an angle greater than 135 degrees. (Here "shut" is 0 degrees, "open at a right angle" is 90 degrees, and "open and swinging around to hit the floor" would be 270 degrees.)

Figure 3:
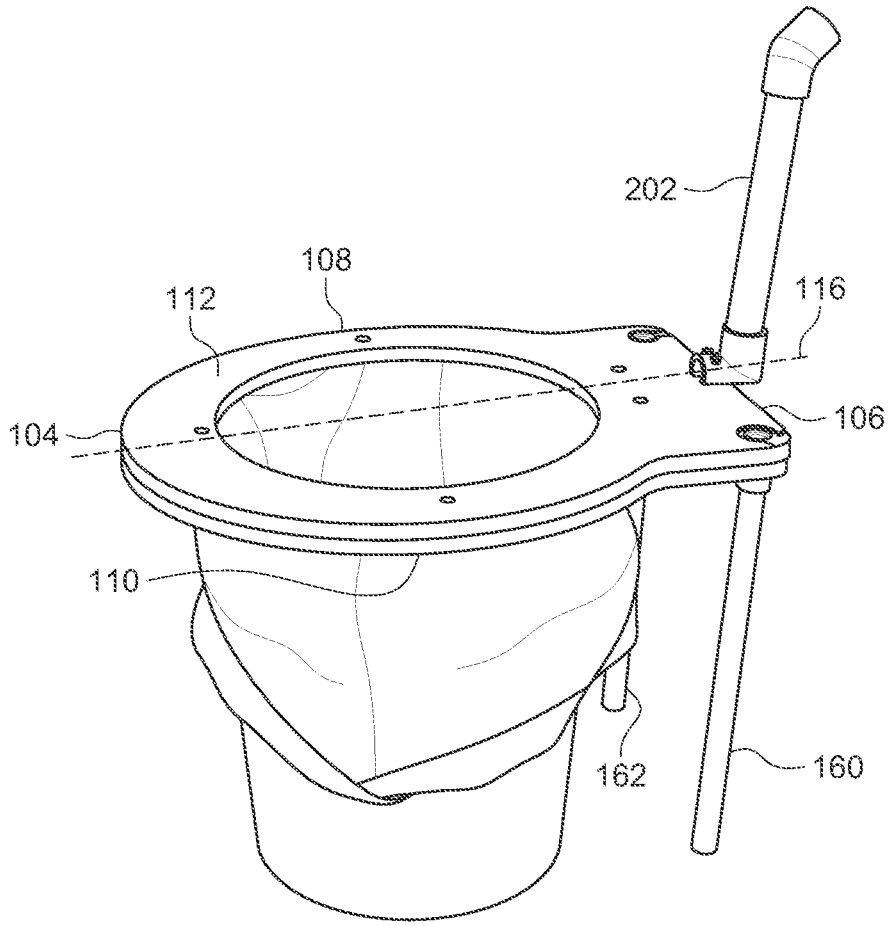
FIG. 3 shows a side overview of the toilet seat support device, with fewer attachments. Here the toilet lid support, right and left legs, and waste receptacle are present. However, in this figure, the standard toilet seat is not attached to the top of the toilet seat support device. This view thus fully exposes the top side of the toilet seat support device.

FIG. 3 shows a side overview of the toilet seat support device (front 104, left side 108, right side 110, backside 106, and top 112 indicated), here with fewer attachments present in order to better show the toilet seat support device itself. In FIG. 3 the toilet lid support (202), the right and left legs (160, 162), and the waste receptacle (152) are present. However, in FIG. 3, the standard toilet seat is not attached to the top of the toilet seat support device. Thus FIG. 3 totally exposes the top layer (also called the top side 112) of the toilet seat support device.

The legs (160, 162) can be attached to the toilet seat support device by various mechanisms. In some embodiments, the right (128) and left (130) leg attachment fixtures can be configured with any of screw threads, snap-fit fasteners, openings to accommodate snap-fit fasteners, slip-neck fasteners, or other reversible attachment mechanism as appropriate to attach to the legs.

Figure 4:
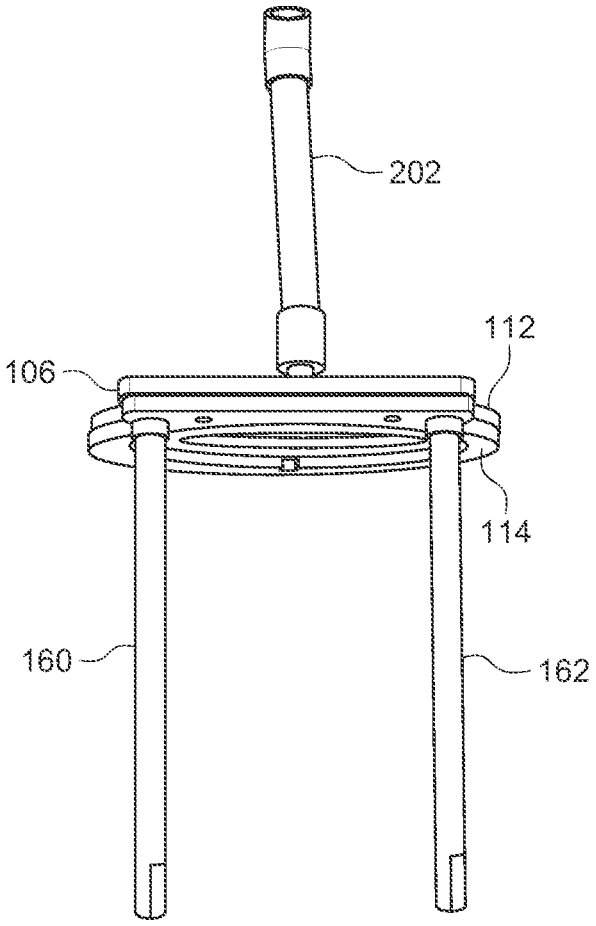
FIG. 4 shows a rear view of the toilet seat support device, here with still fewer attachments. This view shows an angle slightly below the toilet seat support device. This view thus shows more details of the back-side and the bottom side of the toilet seat support device. In this view, the toilet lid support and the right and left legs are attached. However, the standard toilet seat and waste receptacle are absent.

FIG. 4 shows a rear view of the toilet seat support device (backside 106, top 112, bottom 114 indicated) and some but not all attachments, here seen from an angle slightly below the toilet seat support device. This angle shows more details of the backside (106) and bottom layer (also called the bottom side 114) of the toilet seat support device. In FIG. 4, the toilet lid support (202) and the right and left legs (160, 162) are attached, however, to see more details of the toilet seat support device itself, the standard toilet seat and the waste receptacle are absent.

Figure 5:
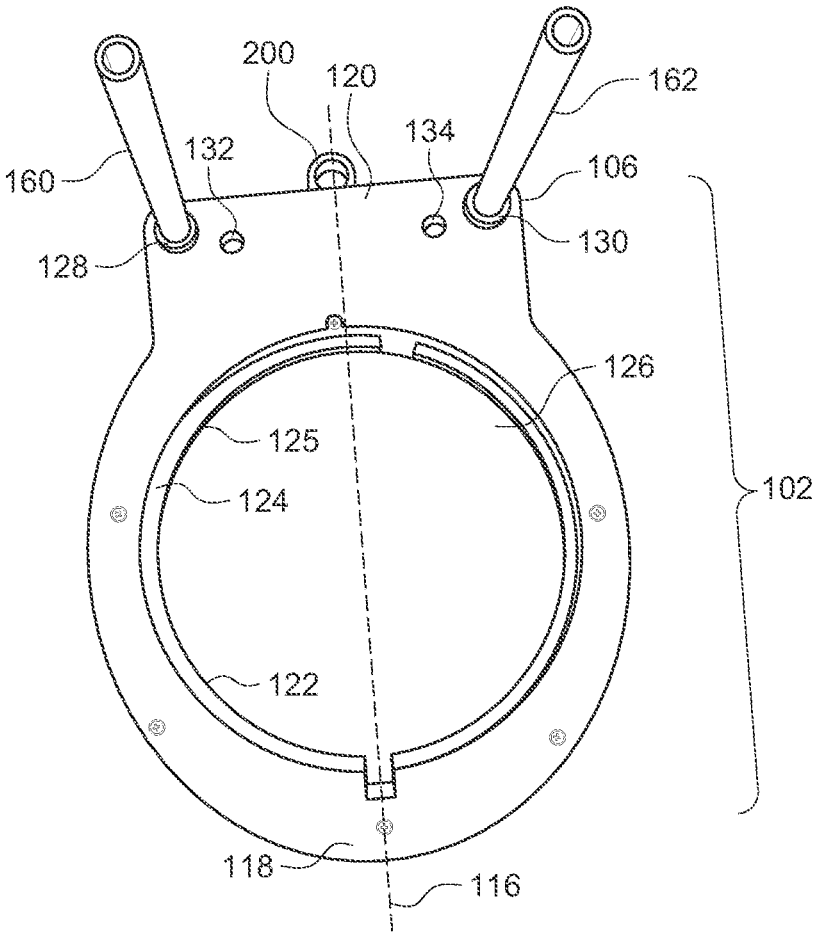
FIG. 5 shows a bottom view of the toilet seat support device previously. As per FIG. 4, the standard toilet lid support and the waste receptacle are absent, but the right and left legs are attached. Here the details of the stepped first and second central opening can be seen. There is a smaller first central oval opening in the top layer of the toilet seat support device, and a somewhat larger second central oval opening in the bottom layer of the toilet seat support device. These are configured so that the larger second central oval opening fits over the rim of the waste receptacle, and the waste receptacle rim then rests on the step surface formed between the first and second central oval opening.

FIG. 5 shows a bottom view of the toilet seat support device (102) and some but not all attachments. As per FIG. 4, the standard toilet lid support and the waste receptacle are absent, but the right and left legs (160,162) are attached. Here the details of the stepped first (122) and second (124) central opening can be seen. There is a smaller radius first central oval opening (122) in the top layer of the toilet seat support, and a somewhat larger radius second central oval opening (124) in the bottom layer of the toilet seat support. This allows the larger radius second central oval opening (124) to fit over the rim (150) of the waste receptacle (152), and this rim (152) then rests on the step surface (125) formed (e.g. between) the smaller radius first central oval opening (122) and the larger radius second central opening (124).

In some embodiments, such as when the first (122) and second (124) openings are circular (one type of oval), the diameter of the smaller first central opening (122) can, for example, have a diameter of 11 inches (5.5 inch radius) and the diameter of the larger second opening can be 11½ inches (e.g. 5.75 inch radius) or larger. The step surface (125) will often be a recessed annulus, often with a width of about ½ inch. It will often be useful to configure these openings so as to be compatible with either standard waste receptacle sizes (e.g. standard bucket sizes), or alternatively to at least be compatible with a specific bucket size that can be sold with the device or at least be recommended by the device instructions for use.

In some embodiments, the distance between the front side (104) and the backside (106) of the unit can be between 16 to 20 inches (such as about 18 inches). The width of the backside (106) can be between 9 and 12 inches (such as 10⅜ inches). The depth of the toilet seat support device will often be between 1 and 2 inches, such as 1½ inch. Here for example, if the toilet seat support device is composed of two layers, the top layer of the toilet seat support device may be ¾ inches deep, and the bottom layer of the toilet seat support device may also be ¾ inches deep.

In some embodiments, the substantially planar toilet seat support device (102) can comprise a plurality of different layers (such as the two layers shown in the figures) of material that are affixed or laminated together. In these examples, the top layer comprises a top layer of material (such as a layer of wood, plywood, or plastic or other material), and the bottom layer will comprise a bottom layer of the same or different material (which again may be wood, plywood, plastic or other material).

Alternatively, in some embodiments, the substantially planar toilet seat support device (102) can comprise a single material. This can be molded or machined plastic or wood, but other materials, including ceramics or metals, are not disclaimed. Here the top layer (or top portion 112) will comprise a top portion of this single material, and the bottom layer (or bottom portion 114) will comprise a bottom portion of this single material, and there will not actually be any separation between the layers.

In some embodiments, the right and left leg attachment fixtures (128, 130) can be pressure fit fixtures that are pressure fit into at least the bottom layer (114) of the toilet seat support device (102). In the embodiment shown in the figures, however, the right and left leg attachment fixtures have been pressure fit through both the top (112) and the bottom (114) layers.

Typically, the toilet seat support device will further comprise right and left legs (160, 162) configured to reversibly attach (e.g. attach, and detach) to the right and left leg attachment fixtures (128, 130). These legs may attach by various mechanisms, including complementary screw threads, complementary snap-fit fasteners, openings to accommodate the snap-fit fasteners, slip-neck fasteners, screws, nuts, bolts, and the like.

Typically, both the right and left legs (160, 162) and the substantially cylindrical waste receptacle (152) will comprise rigid, load-bearing materials, often rigid plastics such as polyvinyl chloride (PVC), high-density polyethylene (HDPE), Polyethylene, and the like. Other materials, such as wood or metal, may also be used. The legs and waste receptacle are configured so that when the right and left legs (160, 162) are attached to the right and left leg attachment fixtures (128, 130), and the upper central opening step (125) is in contact with the rim or lid (150) of the substantially cylindrical waste receptacle (152), and a standard toilet seat (136) is affixed to the seat support device (102), the standard toilet seat will be supported at the height of a standard adult toilet. This will often be between 15 to 19 inches high off the ground or floor, but more broadly can be between 10-12 inches to 20 inches.

The device will typically be configured to support the weight of at least an average adult (e.g. 100 to 300+ pounds). Some heavy-duty models may be configured to support still higher weights, such as 500 pounds and higher. Note that in addition to bearing the user's weight, the load-bearing materials must also absorb the transient forces generated when the user sits down. Thus, structural safety margins such as 2*x* the rated maximum weight may be preferred.

Figure 8A:
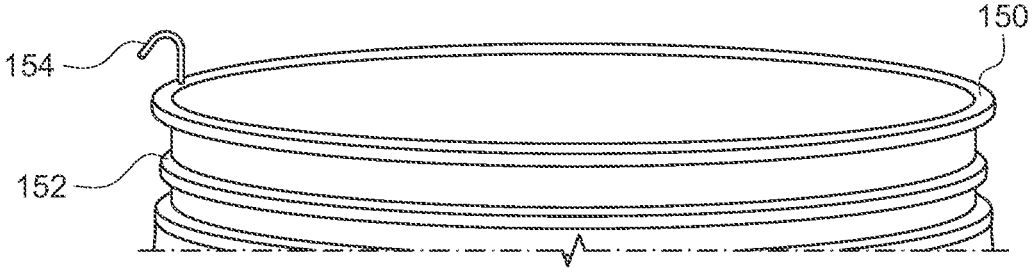
FIG. 8 shows a detail of the top of the cylindrical waste receptacle, showing the rim of the waste receptacle. As previously discussed, this rim rests in the step between the first and central oval openings in the stepped central oval opening.

FIG. 8 shows a detail of the top of the cylindrical waste receptacle (152), showing the rim (150) of the receptacle (152) that rests in the step (125) between the first (122) and second (124) central oval openings in the stepped central oval opening.

In some embodiments, either the device bottom layer (114) or the waste receptacle (e.g. bucket 152) can further comprise at least one attachment mechanism (such as a hook or clamp 154) configured to attach the rim (150) of the substantially cylindrical waste receptacles to the underside (114) of the toilet seat support device (102).

Figure 6:
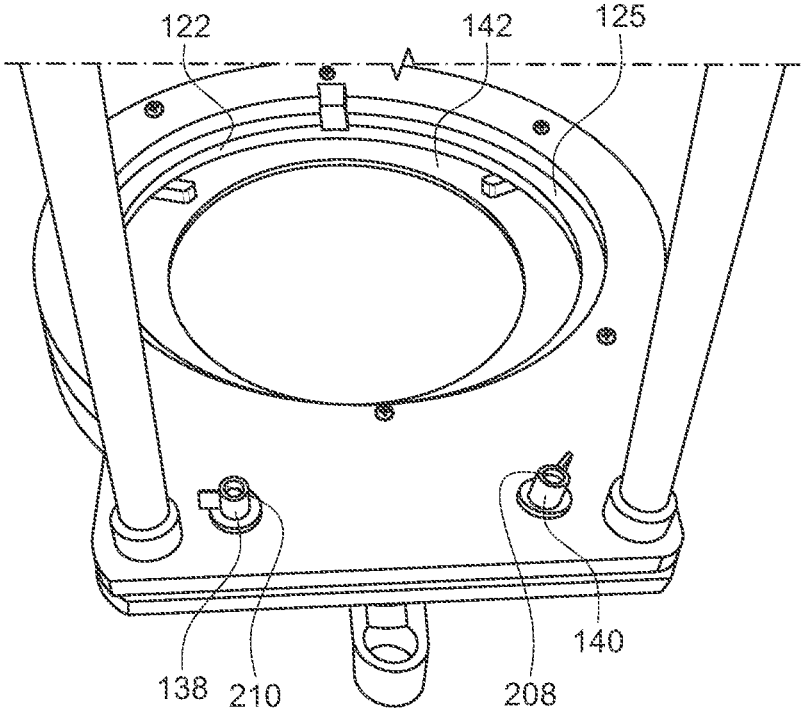
FIG. 6 shows the back underside of the toilet seat support device, viewed from below, showing more details of how the standard toilet seat may be attached to the toilet seat support device.

FIG. 6 shows the underside (114) of the backside (106) of the toilet seat support device, viewed from below. This shows more details of how the standard toilet seat (136) can be attached by way of screws or bolts (208, 210) that pass through the right (132) and left (134) toilet seat fixture openings (essentially holes passing through all of the toilet seat support device layers between the top and bottom). These bolts or screws, as well as the standard toilet seat, can then be held in place by corresponding nuts or screw mounts (138, 140) that affix these screws or bolts into place.

Figure 7:
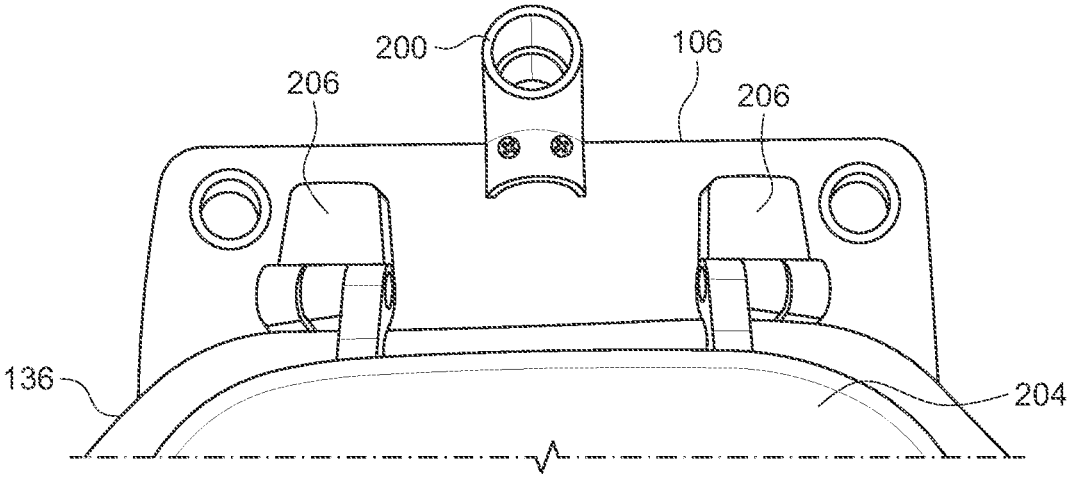
FIG. 7 shows the top backside of the toilet seat support device, viewed from above, showing more details of how the standard toilet seat may be attached to the toilet seat support device.

FIG. 7 shows the top (112) back-side (106) of the toilet seat support device, viewed from above. This shows more details of how the standard toilet seat (136) can be attached to the backside (106) of the device (102). Here the standard toilet seat hinges (206) are shown in more detail. The screws or bolts (208), (210) are hidden by the plastic hinge structure (206).

In some embodiments, the device will further comprise a child seat attachment (300). This child seat attachment will typically comprise a child's seat top portion (302) and a child's seat bottom portion (304). The child seat attachment will typically further comprise a child's seat central opening (306) that passes completely through both the child's seat top portion and the child's seat bottom portion so that waste can be deposited into the waste receptacle (152). The child's seat bottom portion (304) is typically configured to fit inside the device's first central oval opening (122). The child's seat top portion is typically configured with a diameter that is typically larger than the device's first central oval opening (122), but slightly smaller than the diameter of the opening of a standard toilet seat (142). This is so that the child's seat top portion (302) will fill most of the space between the opening of the standard toilet seat (142), and the child's seat central opening (306) so that the child will be supported at the level of the standard toilet seat, and not fall further into the standard toilet seat opening (142).

Figure 9:
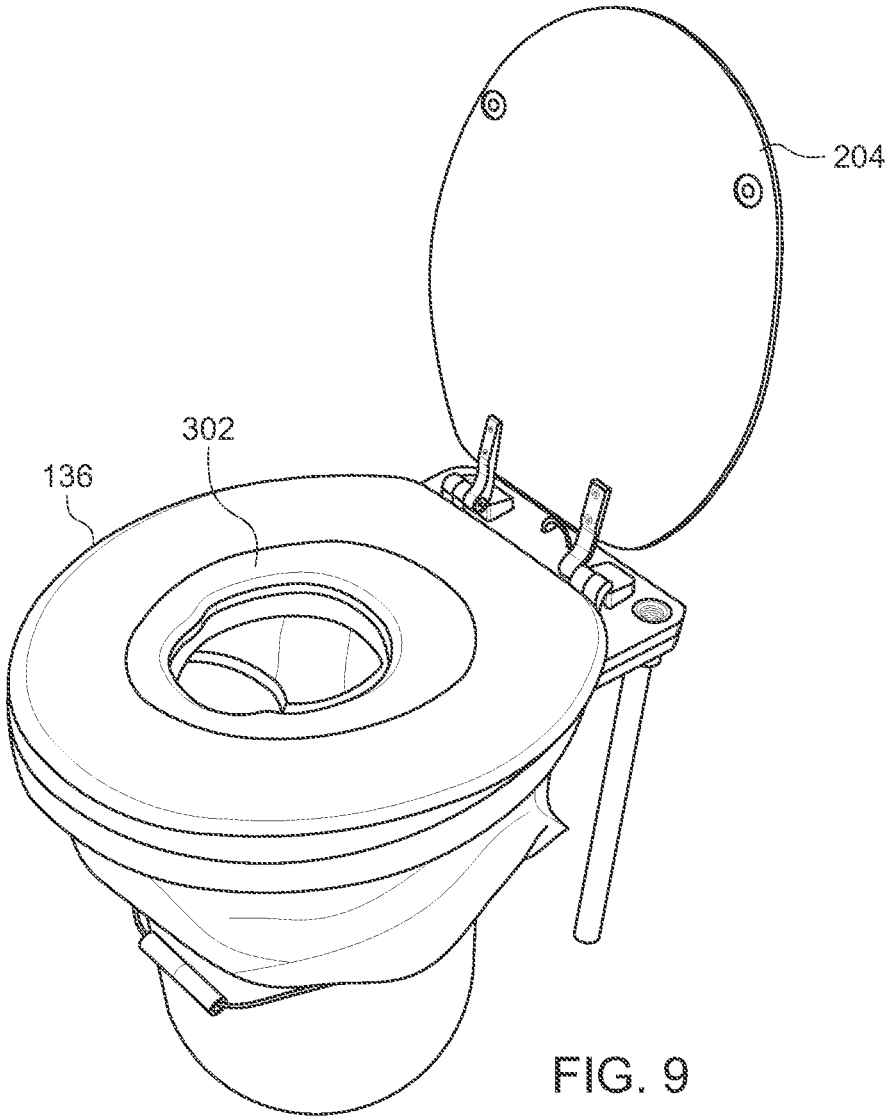
FIG. 9 shows an embodiment of the device that has also been equipped with an optional child's seat attachment. Here the standard toilet seat is in a "down" position.

FIG. 9 shows an embodiment of the device that has also been equipped with an optional child's seat attachment. Here the child's seat top portion (302) shown. In FIG. 9, the standard toilet seat (136) is in a "down" position, and the standard toilet seat lid (204) is in an "up" position. This lid is resting at an angle of about 90 degrees against the toilet lid support (202*m* here hidden because it is behind the lid 204).

Figure 10:
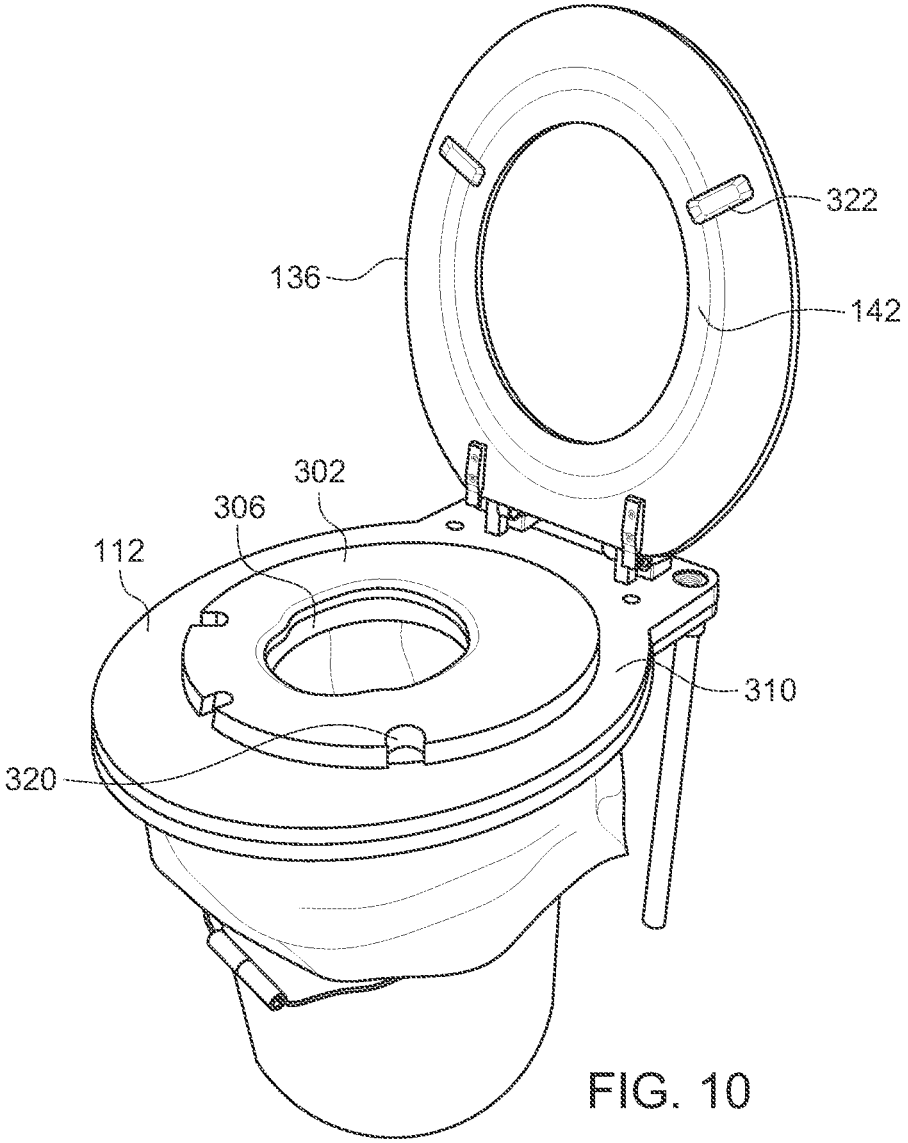
FIG. 10 shows the optional child's seat attachment. Here the standard toilet seat is in an "up" position. This view more clearly shows how the child's seat is positioned on the top side and top layer of the toilet seat support device.

FIG. 10 shows the optional child's seat attachment (top portion 302) positioned on the top layer (top side 112) of the toilet seat support device (102). Here the standard toilet seat (136) is in an "up" position.

Figure 11:
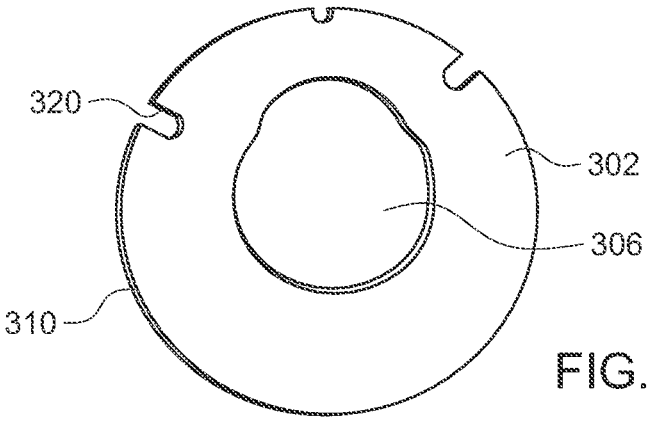
FIG. 11 shows a top view of the optional child's seat attachment.

FIG. 11 shows a top view of the optional child's seat attachment.

Figure 12:
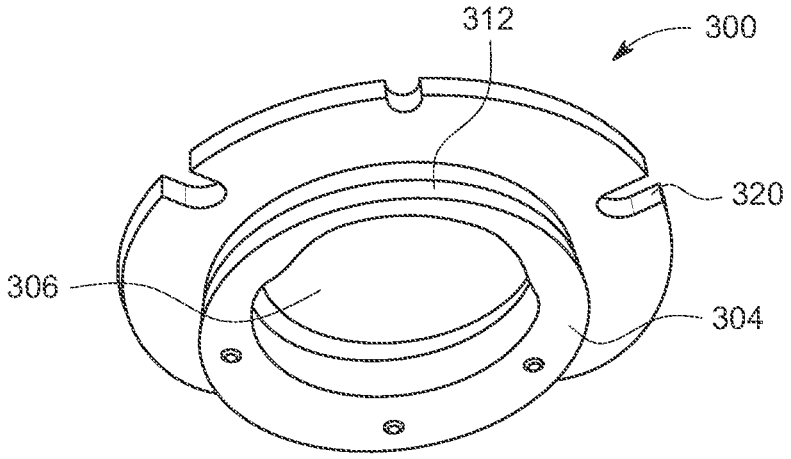
FIG. 12 shows a bottom view of the optional child's seat attachment.

FIG. 12 shows a bottom view of the optional child's seat attachment.

In some embodiments, the optional child's seat attachment may have, on the top portion of the child's seat attachment, an outer diameter (310) that is equal to or only a fraction of an inch smaller than, the diameter of the standard toilet seat opening (142) (such as around 11½ inches). The child's seat attachment will typically have its own opening diameter (306). This is smaller than the standard toilet seat opening such as between about 5-6 inches in diameter (e.g. 5/¾ inches in diameter).

The lower portion of the child's seat attachment may have an outer diameter (312) that is equal to, or only a fraction of an inch smaller than, the diameter of the first central oval opening (122).

Thus if, for example, the first central oval opening (122) has a diameter of 11½ inches, the lower portion of the optional child's seat attachment may have a diameter equal to, or a fraction of an inch less than, 11½ inches.

The height of the optional child's seat unit may often be around 1½ inch. Here the lower portion of the child's seat unit, such as the lower ¾ inch of the optional child's seat unit, will be configured to fit into the first central oval opening (122). By contrast, the upper portion of the child's seat attachment, such as the upper ¾ inch of the optional child's seat unit, will be raised a certain amount, such as about ¾ inches above the top layer (112) of the toilet seat support. This configuration thus raises the top portion of the optional child's seat to about the same height as the surrounding standard toilet seat (136). Indeed, the depth of the upper portion of the optional child's seat support unit can be chosen to exactly match the corresponding height of a given standard toilet seat (136) when mounted onto the toilet seat support device (102), and the instructions for use can recommend certain matches between the child's seat support unit and various standard toilet seats. This can position the top of the child's seat so that it is substantially flush with the standard toilet seat (136), as is shown in FIG. 9.

In some embodiments, the optional child's seat support will further have various locating notches (320) or pins disposed along the upper circumference of the child's seat support to facilitate placement and accommodate any corresponding bumpers (322) that may be present on the standard toilet seat.

In some embodiments, the toilet seat support device may further comprise a urine collection attachment fixture (350) for a urine collection device.

Figure 13:
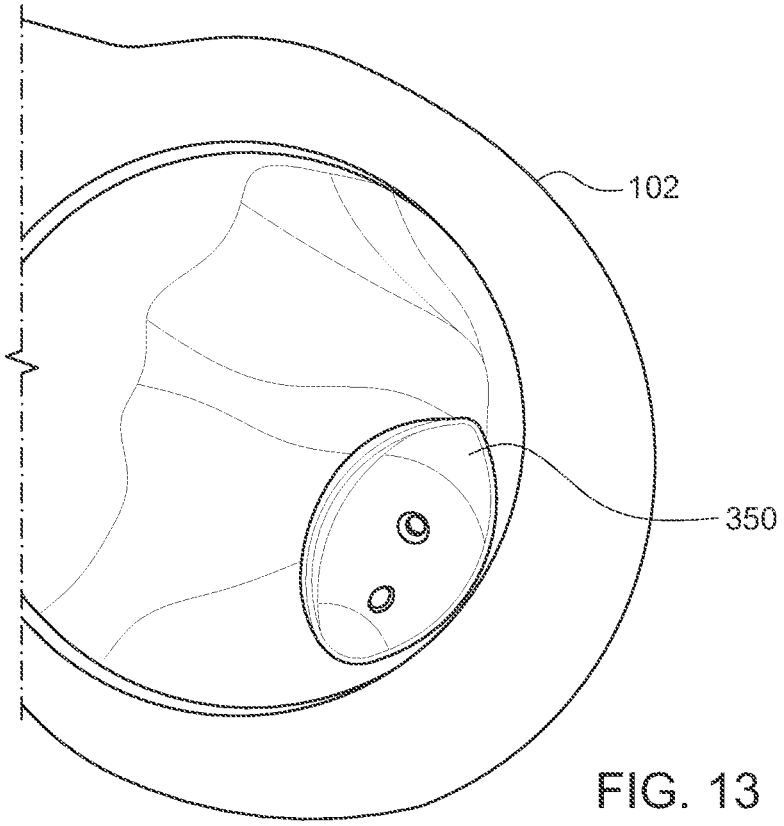
FIG. 13 shows the device equipped with a urine collection device.

FIG. 13 shows the toilet seat support device (102) and waste receptacle (152) equipped with a urine collection device (350). This urine collection device can be a funnel that collects urine and directs the urine to an internal or external storage container (not shown) that separates the urine from any solid wastes stored in the waste receptacle (152). Such separation is often preferred for composting toilets.

More specifically, in some embodiments, the urine collection device may comprise a funnel (350) and a separate urine storage container. This urine collection device may be held in place by a urine collection device fixture such as a hook or other attachment mechanism. As previously discussed, the urine collection device (350) may be further configured to store urine separately from other waste stored in the substantially cylindrical waste receptacle (152).

In some embodiments, the toilet seat device (102) may be sold separately as the basic chassis for a portable toilet, along with instructions for use. In other embodiments, the toilet seat device (102) may be sold as a kit containing other components, such as the legs, waste receptacle, urine collection devices and so on. Often the device will be sold or stored in a disassembled state, assembled when a portable toilet is desired, and then disassembled again.

The invention claimed is:

1. A toilet seat support device for a portable toilet, said device comprising:

a substantially planar toilet seat support device comprising a front side, a backside, a left side, a right side, a top layer, and a bottom layer;

said toilet seat support device having an axis of symmetry passing between a middle of said front side and a middle of said backside so that said left side is symmetric with respect to said right side;

said toilet seat support device further comprising a first central oval opening in said top layer superimposed over a larger second central oval opening in said bottom layer thus producing a stepped central oval opening passing completely through said top layer and said bottom layer;

said bottom layer of said backside configured with right and left leg attachment fixtures, each positioned on opposite sides of said axis of symmetry;

said top layer and said bottom layer of said backside configured with right and left toilet seat fixture openings, each positioned on opposite sides of said axis of symmetry, and positioned and configured so that when a toilet seat is mounted on said top layer by way of any of bolts and screws protruding through said right and left toilet seat fixture openings, the toilet seat opening is positioned above said first central opening in said top layer;

said stepped central oval opening configured with an upper central opening step and a lower central opening step so that said lower central opening step can pass over a rim of a substantially cylindrical waste receptacle, while said upper central opening step is in contact with said rim of said substantially cylindrical waste receptacle.

2. The device of claim 1, wherein said backside further comprises at least one toilet lid support attachment fixture configured so that when a toilet lid support is attached to said toilet lid support attachment fixture, and a toilet seat opening comprising a toilet seat lid and hinge structure is mounted on said top layer by way of any of said bolts and screws protruding through said right and left toilet seat fixture openings, said toilet lid support will prevent said toilet seat lid from swinging around said hinge structure to an angle greater than 135 degrees.

3. The device of claim 1, wherein said right and left leg attachment fixtures are configured with any of screw threads, snap-fit fasteners, openings to accommodate snap-fit fasteners or slip-neck fasteners.

4. The device of claim 3, wherein said right and left leg attachment fixtures are pressure fit fixtures that are pressure fit into at least said bottom layer.

5. The device of claim 3, further comprising right and left legs configured to reversibly attach to said right and left leg attachment fixtures by any of complementary screw threads, complementary snap-fit fasteners, openings to accommodate said snap-fit fasteners or slip-neck fasteners.

6. The device of claim 1 wherein any of said bottom layer and said waste receptacle further comprises at least one attachment mechanism configured to attach the rim of said substantially cylindrical waste receptacle to said device.

7. The device of claim 1, further comprising right and left legs configured to attach to said right and left leg attachment fixtures, wherein said right and left legs, and said substantially cylindrical waste receptacle, comprise rigid, load-bearing materials, so that when said right and left legs are attached to said right and left leg attachment fixtures, and said upper central opening step is in contact with said rim of said substantially cylindrical waste receptacle, and a toilet seat is affixed to said seat support device, said toilet seat is supported at a height of an adult toilet, and said device can support a weight an adult.

8. The device of claim 1, further comprising a child seat attachment;

said child seat attachment comprising a child seat top portion and a child seat bottom portion, said child seat attachment further comprising a child seat central opening passing completely through said child seat top portion and said child seat bottom portion;

said child's seat bottom portion configured to fit inside said first central oval opening;

said child seat top portion configured with dimensions larger than said first central oval opening, and smaller than the opening of a toilet seat, so that said child's seat portion fills at least some of the space between the opening of said toilet seat, and said child seat central opening.

9. The device of claim 1, wherein said portable toilet is a composting toilet and said toilet seat support device further comprises a urine collection funnel.

10. The device of claim 9, wherein said urine collection device comprises a funnel and a separate urine storage container, and said urine collection device is configured to store urine separately from other waste stored in said substantially cylindrical waste receptacle.

11. The device of claim 1, said substantially planar toilet seat support device comprises a plurality of different layers of material that are affixed or laminated together, and said top layer comprises a top layer of material, and said bottom layer comprises a bottom layer of material.

12. The device of claim 1, wherein said substantially planar toilet seat support device comprises a single material, and said top layer comprises a top portion of said single material, and said bottom layer comprises a bottom portion of said single material.

13. A toilet seat support device for a portable toilet, said device comprising:

a substantially planar toilet seat support device comprising a front side, a backside, a left side, a right side, a top layer, and a bottom layer;

said toilet seat support device having an axis of symmetry passing between a middle of said front side and a middle of said backside so that said left side is symmetric with respect to said right side;

said toilet seat support device further comprising a first central oval opening in said top layer superimposed over a larger second central oval opening in said bottom layer thus producing a stepped central oval opening passing completely through said top layer and said bottom layer;

said bottom layer of said backside configured with right and left leg attachment fixtures, each positioned on opposite sides of said axis of symmetry;

wherein said right and left leg attachment fixtures are configured with any of screw threads, snap-fit fasteners, openings to accommodate snap-fit fasteners or;

further comprising right and left legs configured to attach to said right and left leg attachment fixtures by any of complementary screw threads, complementary snap-fit fasteners, slip-neck fasteners, openings to accommodate said snap-fit fasteners, slip-neck fasteners, or other reversible attachment mechanism;

said top layer and said bottom layer of said backside configured with right and left toilet seat fixture openings, each positioned on opposite sides of said axis of symmetry, and positioned and configured so that when a toilet seat is mounted on said top layer by way of any of bolts or screws protruding through said right and left toilet seat fixture openings, the toilet seat opening is positioned above said first central opening in said top layer;

said stepped central oval opening configured with an upper central opening step and a lower central opening step so that said lower central opening step can pass over a rim of a substantially cylindrical waste receptacle, while said upper central opening step is in contact with said rim of said substantially cylindrical waste receptacle; and wherein said right and left legs, and said substantially cylindrical waste receptacle, comprise rigid, load-bearing materials.

14. The device of claim 13, wherein said backside further comprises at least one toilet lid support attachment fixture configured so that when a toilet lid support is attached to said toilet lid support attachment fixture, and a toilet seat comprising a toilet seat lid and hinge structure is mounted on said top layer by way of any of bolts and screws protruding through said right and left toilet seat fixture openings, said toilet lid support will prevent said toilet seat lid from swinging around said hinge structure to an angle greater than 135 degrees.

15. The device of claim 13 wherein said bottom layer further comprises at least one attachment mechanism configured to attach to said rim of said substantially cylindrical waste receptacle.

16. The device of claim 13, wherein when said right and left legs are attached to said right and left leg attachment fixtures, and said upper central opening step is in contact with said rim of said substantially cylindrical waste receptacle, and a toilet seat is affixed to said seat support device, said toilet seat is supported at a height of an adult toilet, and said device can support a weight of an adult.

17. The device of claim 13, wherein said portable toilet is a composting toilet, and said toilet seat support device further comprises a urine collection funnel.

* * * * *